United States Patent [19]

Bengtsson et al.

[11] Patent Number: 4,757,243

[45] Date of Patent: Jul. 12, 1988

[54] METHOD AND MEANS FOR A REGULATOR FOR THE SERVO CONTROL OF A MARINE CRAFT

[75] Inventors: Leif Bengtsson, Täby; Nils Danielsson, Motala, both of Sweden

[73] Assignee: Affärsverket FFV, Eskilstuna, Sweden

[21] Appl. No.: 862,229

[22] PCT Filed: Aug. 27, 1985

[86] PCT No.: PCT/SE85/00317

§ 371 Date: May 1, 1986

§ 102(e) Date: May 1, 1986

[87] PCT Pub. No.: WO86/01585

PCT Pub. Date: Mar. 13, 1986

[30] Foreign Application Priority Data

Sep. 6, 1984 [SE] Sweden ..... 8404478

[51] Int. Cl.[4] ..... G05D 1/60

[52] U.S. Cl. ..... 318/589; 318/632; 114/20.1

[58] Field of Search ..... 318/588, 589, 616, 632, 318/584; 114/20.1, 23

[56] References Cited

U.S. PATENT DOCUMENTS

| | | | |
|---|---|---|---|
| 2,677,513 | 5/1954 | Kliever | 318/584 X |
| 2,701,111 | 2/1955 | Schuck | 318/584 X |
| 3,127,864 | 4/1964 | Bentkowsky et al. | 318/589 X |
| 3,228,370 | 1/1966 | Daly et al. | 318/412 X |
| 3,673,977 | 7/1972 | Hendley | 318/589 X |
| 4,024,648 | 2/1977 | Reid et al. | 318/588 |
| 4,046,341 | 9/1977 | Quinlivan | 318/584 X |
| 4,049,223 | 9/1977 | Watson | 318/584 |
| 4,069,784 | 1/1978 | Hedström et al. | 318/588 |
| 4,524,710 | 6/1985 | Scott | 318/588 X |
| 4,538,230 | 8/1985 | Reust et al. | 318/589 |
| 4,595,867 | 6/1986 | Cognevich et al. | 318/588 |
| 4,622,504 | 11/1986 | Yamazaki | 318/632 X |

*Primary Examiner*—Benjamin Dobeck

*Attorney, Agent, or Firm*—Fleit, Jacobson, Cohn & Price

[57] ABSTRACT

Method and means for a regulator for the servo control of a marine craft, for instance a torpedo, with variable speed and angle of attack. A first sensor (1) monitors the angle of attack, while a second sensor (8) monitors the depth of the craft. A revolution counter (3) and a filter (4) create an acceleration-compensating signal which is subtracted from an angle-of-attack signal emitted by the first sensor (1), whereupon the signal is transmitted to a rudder servo system.

2 Claims, 1 Drawing Sheet

METHOD AND MEANS FOR A REGULATOR FOR THE SERVO CONTROL OF A MARINE CRAFT

TECHNICAL FIELD

The present invention relates to a method for a regulator for the servo control of a marine craft, for instance a torpedo, with variable speed and angle of attack, involving the detecting of the angle of attack of the craft and the transmission of a command signal representing the angle of attack to a control circuit contained in the regulator.

The invention also relates to a means for the execution of the method comprising a sensor capable of detecting the angle of attack of the craft and of transmitting a command signal representing the angle of attack to a control circuit contained in the regulator.

The expression angle of attack is used by accepted practice to denote the angle between the resulting velocity vector and the centre line of the craft. In the special case where the craft travels at a constant altitude, the resulting velocity vector lies in the horizontal plane.

A control system for a craft may have two or more signal transmitters which interact to provide a control function, for instance as in the depth regulator in a torpedo. In case of the depth regulator, which provides depth control for the torpedo, command signals are obtained not only from depth-detecting sensors, but also from angle-detecting sensors.

The depth of the torpedo is detected in this way by means of a sensor in the form of a depth indicator which measures the absolute pressure. The indicator can consist of four strain gauges in bridge connection mounted on a membrane with a vacuum on one side and water pressure on the other side.

The angle of attack of the torpedo can be detected by means of a sensor in the form of a pendulum or an electrolytic angle indicator.

The command signals from the two sensors are processed in an electronic control system and are transmitted to a rudder servo system.

BACKGROUND ART

Until now the depth control of the torpedo has been based only on the detecting of the depth and angle of attack of the torpedo. However, a control system of this kind is unsatisfactory for a torpedo with the facility to vary its speed during its course, because it is associated with depth errors during the speed variation period. This is attributable to the fact that all angle of attack sensors of the aforementioned types are sensitive to acceleration. During variation of the speed, acceleration forces will accordingly influence the behaviour of the torpedo. In the case of an increase in speed, but without any change in depth, the angle of attack sensor will thus transmit a signal corresponding to the signal which is transmitted when the torpedo is rising. The regulator would, if nothing were to be done to counter that effect, cause the torpedo to dive in order to achieve the normal angle of attack.

SUMMARY OF THE INVENTION

The object of the present invention is, therefore, to propose a method and a means of the kind indicated by way of introduction by which the angle of attack signal transmitted to the control circuit is not influenced by variations in the speed of the craft. This object is achieved by providing the method and the means in accordance with the invention.

Further developments of the invention are apparent from the subsidiary claims.

The invention is described below in greater detail with reference to the accompanying drawing, which shows a preferred embodiment of the invention.

PREFERRED EMBODIMENT

Figure 1:
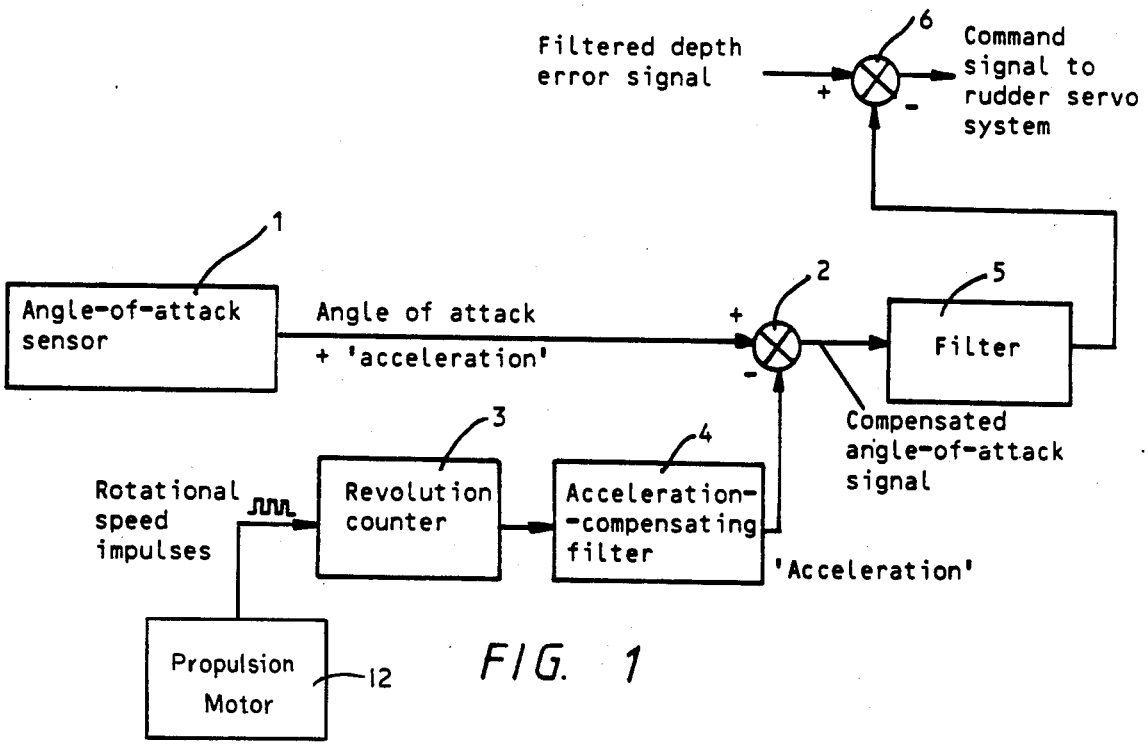
FIG. 1 shows a block diagram of the preferred embodiment.

In FIG. 1 the reference designation 1 is used to denote an angle of attack sensor, the output signal from which is fed into a summing circuit 2. This may well be in the form of an electrolytic angle sensor. As such angle sensors are already generally familiar, and as its design does not constitute part of the present invention, the sensor is not described here in any more detail.

A sensor in the form of a revolution counter 3 counts the number of revolution impulses from a propulsion motor 12 in the torpedo (also not shown). The output signal from the revolution counter 3 is fed into an acceleration-compensating filter 4. In the event of variations in the speed of rotation corresponding to a variation in the speed of the torpedo, the filter 4 will generate a signal corresponding to the variation in the speed which will be caused to influence the angle-of-attack signal in such a way that it is subtracted from the latter in the summing circuit 2. The output signal from the summing circuit 2 thus constitutes a compensated angle-of-attack signal which corresponds to an actual angle of attack in spite of the acceleration.

The dimensioning of the filter 4 which must be undertaken in order for its output signal to correspond in a correct fashion to the correction signal which is to be subtracted from the output signal of the revolution counter 3 obviously calls for expert calculations to be made with which it is not considered necessary to burden this specification.

Output signals from the summing circuit 2 are filtered in a filter 5 and are delivered in a summing circuit 6 to the command signals from a deep control channel (not shown). Such a command signal constitutes a filtered depth error signal (i.e. the difference between the desired value and the actual value). The output signal from the totalizing circuit 6 is fed into a rudder servo system forming part of the torpedo.

Figure 2:
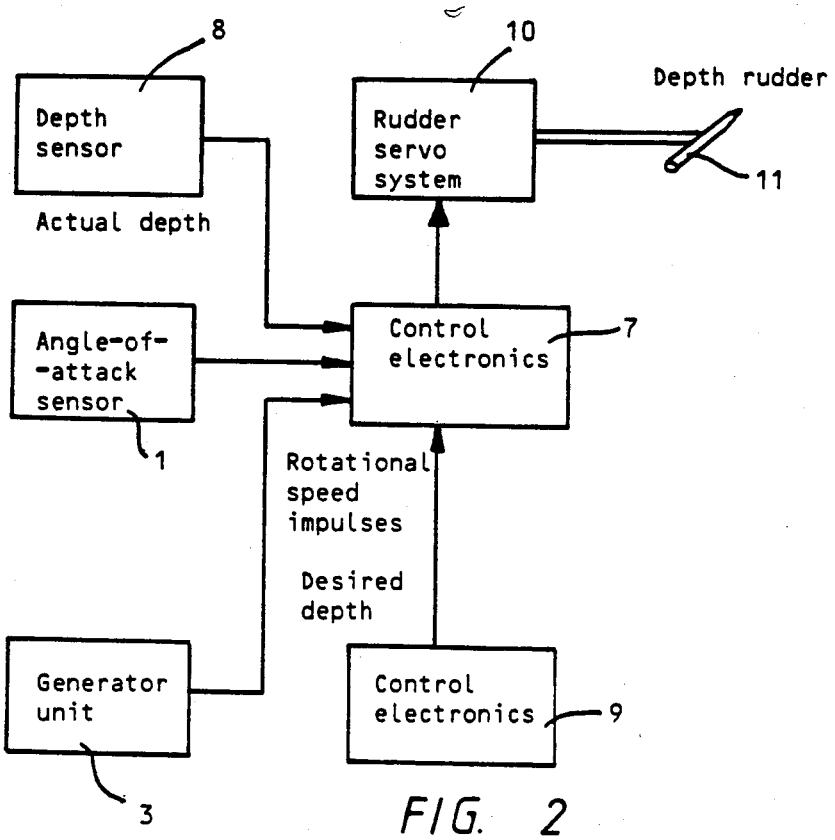
FIG. 2 shows the preferred embodiment incorporated into a control system for a torpedo.

FIG. 2 shows a control system for the torpedo in which are to be found the angle-of-attack sensor 1 and the revolution counter 3 shown in FIG. 1. The components 2, 4, 5 and 6 shown in FIG. 1 are shown in FIG. 2 combined together to form an electronic control circuit 7. The reference designation 8 is used to denote a depth sensor, 9 to denote an electronic control for the desired depth, 10 to denote the rudder servo system of the torpedo, and 11 to denote the depth rudder of the torpedo.

We claim:

1. A control system for a marine craft comprising:

a sensor for detecting the angle of attack of a marine craft and transmitting a command signal representing the angle of attack to a control circuit in a regulator for servo control of marine craft;

the sensor being of the acceleration sensitive type, such as a pendulum or an electrolytic angle of attack indicator such that said command signal is a true angle of attack signal only if the marine craft travels at a constant speed;

a transmitter for generating a signal representing a variation in the speed of the marine craft; and a summing circuit for subtracting said signal representing a variation in the speed of the marine craft from said command signal in order to generate an acceleration compensated angle of attack signal.

2. The control system of claim 1, said transmitter comprising:

a propulsion motor revolution counter transmitting a rotational speed signal; and an acceleration-compensating filter receiving the rotational speed signal from said propulsion motor revolution counter, and outputting a signal representing a variation in the speed of the marine craft.

* * * * *